US007896286B2

(12) United States Patent
Milton

(10) Patent No.: US 7,896,286 B2
(45) Date of Patent: Mar. 1, 2011

(54) CORE FOR A ROLL OF MATERIAL

(75) Inventor: Peter George Milton, Forest Row (GB)

(73) Assignee: Real Time Logistics Solutions Limited, Surrey (GB)

( * ) Notice: Subject to any disclaimer, the term of this patent is extended or adjusted under 35 U.S.C. 154(b) by 298 days.

(21) Appl. No.: 11/665,860

(22) PCT Filed: Sep. 23, 2005

(86) PCT No.: PCT/GB2005/003699
§ 371 (c)(1),
(2), (4) Date: Nov. 5, 2007

(87) PCT Pub. No.: WO2006/043021
PCT Pub. Date: Apr. 27, 2006

(65) Prior Publication Data

US 2008/0073457 A1 Mar. 27, 2008

(30) Foreign Application Priority Data

Oct. 21, 2004 (GB) ..... 0423409.2

(51) Int. Cl.
*B65H 75/14* (2006.01)

(52) U.S. Cl. ..... 242/610.4; 242/610.5; 242/610.6; 242/611.2

(58) Field of Classification Search ..... 242/596, 242/596.7, 572, 573, 573.1–573.4, 610.4–610.6, 242/611.2, 609, 609.1, 612
See application file for complete search history.

(56) References Cited

U.S. PATENT DOCUMENTS

| | | | | |
|---|---|---|---|---|
| 1,671,724 | A | 5/1928 | Johancen et al. | |
| 2,585,999 | A * | 2/1952 | Bunch | 242/597.6 |
| 3,505,159 | A * | 4/1970 | Winter | 428/164 |
| 3,713,601 | A | 1/1973 | Buhrman et al. | |
| 5,236,141 | A * | 8/1993 | Kewin | 242/611.2 |
| 5,260,142 | A * | 11/1993 | Kawabe et al. | 428/654 |
| 5,393,010 | A * | 2/1995 | Renck | 242/613.5 |
| 5,414,032 | A * | 5/1995 | Akao | 524/115 |
| 5,657,944 | A | 8/1997 | Kewin et al. | |

(Continued)

FOREIGN PATENT DOCUMENTS

FR 2 848 272 A 6/2004

(Continued)

*Primary Examiner* — Sang Kim
(74) *Attorney, Agent, or Firm* — Iandiorio Teska & Coleman

(57) ABSTRACT

A core (16) for a roll of material, which core (16) comprises a body portion (18), a first member which is removably secured to a first end (22) of the body portion (18), a first bore (24) through the first end member (20), a second end member (26) which is removably secured to a second end (28) of the body portion (18), a second bore through the second end member (26), a third bore (30) through the body portion (18), the first, second and third bores all having a common longitudinal axis, the first bore (24) having a smooth inner surface (32) whereby the first bore (24) is able to receive a chuck (34) such that centering of the chuck (34) is facilitated by the smooth inner surface of the first bore (24), the second bore having a smooth inner surface (32) whereby the second bore is able to receive a chuck (34) such that centering of the chuck (34) is facilitated by the smooth inner surface (32) of the second bore, the body portion being made of a metal, and the first and second end members (20, 26) each being made of a plastics material.

13 Claims, 4 Drawing Sheets

U.S. PATENT DOCUMENTS

| | | | | |
|---|---|---|---|---|
| 5,829,713 | A * | 11/1998 | Kewin | 242/613.5 |
| 5,857,643 | A | 1/1999 | Czuprynski et al. | |
| 6,099,178 | A * | 8/2000 | Spurr et al. | 400/207 |
| 6,305,638 | B1 * | 10/2001 | Rodriguez | 242/599.4 |
| 2001/0042810 | A1 * | 11/2001 | Christensen et al. | 242/597.2 |
| 2002/0027179 | A1 * | 3/2002 | Fujiwara et al. | 242/532.3 |
| 2003/0127555 | A1 * | 7/2003 | Squires | 242/611.2 |
| 2003/0183718 | A1 * | 10/2003 | Davis et al. | 242/600 |
| 2004/0245368 | A1 | 12/2004 | Kewin | |

FOREIGN PATENT DOCUMENTS

| | | | |
|---|---|---|---|
| GB | 2400093 | A | 10/2004 |

* cited by examiner

CORE FOR A ROLL OF MATERIAL

This invention relates to a core for a roll of material. The material may be printing paper for the printing industry or other material for other industries.

Known cores for rolls of printing paper are traditionally in the form of cardboard tubes. These cardboard tubes have traditionally been thrown away when the roll of paper on the cardboard tube has been used up. However, this represents a significant cost item, and their disposal is wasteful, both in terms of the need to dispose of the cores, and in terms of the need to provide new cores. In addition, in the printing industry, developments in technology have provided reel tracking systems for tracking the rolls of paper as they progress from paper mills to warehouses, docks, customer paper stores, and printing machines. These tracking systems involve tagging the cores with identity tags. The identity tags are also a significant cost item, and users are not satisfied at having to pay for the cost of the identity tags if they are thrown away with the used cores when the printing paper on the cores has been used up.

An attempt to meet the above problem is disclosed in GB-A-2400093 which discloses a core for a roll of printing paper, which core comprises a body portion, a bore through the body portion, a first end member which is removably secured to the first end of the body portion, and a second end member which is removably secured to a second end of the body portion, the core being made of a plastics material. The core disclosed in GB-A-2400093 is a large improvement on the known cardboard cores. However, the core of GB-A-2400093 presents its own problems. More specifically, industry tends to require ever increasing larger rolls of material, in terms of the diameter of the rolls and/or width of the rolls, and also ever increasing speeds of rotation. Beyond a certain size, during use, cores made of cardboard or the plastics material become unstable and prone to breaking. The instability and the breaking provide serious potential hazards for personnel operating machinery, for example printing machinery using up printing paper on a core. The machinery itself can also be damaged. Thus health and safety requirements negate against the use of a core being made of cardboard and also made of a plastics material.

It is an aim of the present invention to reduce the above mentioned problems.

Accordingly, the present invention provides a core for a roll of material, which core comprises a body portion, a first end member which is removably secured to a first end of the body portion, a first bore through the first end member, a second end member which is removably secured to a second end of the body portion, a second bore through the second end member, and a third bore through the body portion, the first, second and third bores all having a common longitudinal axis, the first bore having a smooth inner surface whereby the first bore is able to receive a chuck such that centering of the chuck is facilitated by the smooth inner surface of the first bore, the second bore having a smooth inner surface whereby the second bore is able to receive a chuck such that centering of the chuck is facilitated by the smooth inner surface of the second bore, the body portion being made of a metal, the first and second end members each being made of a plastics material, the first end member having a first flange which abuts against the first end of the body portion, the second end member having a second flange which abuts against the second end of the body portion, the body portion having an uninterrupted outer surface which is such that the first and second ends of the body portion are not reduced in material and strength, the first and second flanges and the body portion all having the same outside diameter such that the core has a continuous rigid non-deformable outer surface for receiving the roll of material, and the core including a radio frequency operable identity tag for enabling tracking of the core in use.

The making of the body portion of a metal helps to overcome the above mentioned instability and breaking problems caused by making the core of cardboard or a plastics material. More specifically, during fast rotational speeds of a roll of material on machinery such for example as printing machinery, the body portion tends to heat up too much if the body portion is made of a plastics material. The result is that the plastics material looses some of its rigidity and then zags so that the body portion no longer extends in a straight line. A core made of cardboard may loose rigidity if subjected to a humid atmosphere. During the rotation, cardboard and plastics material cores tend to become out of balance, with the body portion causing the core to wobble alarmingly and even break. This problem is able to be avoided with a body portion made of metal. The metal does however cause its own problems insofar as the above mentioned use of the identity tags would normally be prevented using a core made entirely of metal. This problem is overcome by having the first and second end members made of the plastics material. The plastics material will normally be chosen such that it is sufficiently soft to give required friction for chucks which are inserted into the first and second members and which are driven in order to cause rotation of the roll of the material. These chucks must not slip in the first and second bores of the first and second end members respectively. Also, the plastics material should not be so hard as to crack during use under cold conditions, for example in countries with cold climates, The retention of the first and the second end members enables the core to be refurbished and not to be thrown away, thereby overcoming the problem of unnecessary wastage that occurs with the cardboard tubes. The use of the metal for the body portion overcomes the problem of having a body portion made of the plastics material or cardboard. The making of the first and second end members in the plastics material overcomes the problem of the metal preventing use of the identity tags. The entire core can be used more than once. After this multiple use, if an end should get damaged, then the end can easily be replaced in order to enable the entire core to carry on being used for further times. The process of the multiple use, repair and further multiple use can be repeated as desired and appropriate.

The core may be one in which the first end member is inserted into the third bore at the first end of the body portion, and in which the second end member is inserted into the third bore at the second end of the body portion. Insertion of the first and second end members into the third bore enables the outside diameter of the body portion to remain the same. If the first and second end members are inserted over the first and second ends of the body portion, then the outside diameter of the body portion becomes increased unless the first and second ends of the body portion are first reduced in diameter.

Preferably, the core is one in which the first end of the body portion receives an insert portion on the first end member, and in which the second end of the body portion receives an insert portion on the second end of the body member.

The core may be one in which the third bore has longitudinally extending splines, and in which the insert portions on the first and second end members have complementary grooves. If desired, the insert portions on the first and second members may be regarded as having the longitudinally extending splines, in which case the third bore will have the complementary grooves. The longitudinally extending splines along the third bore considerably increase the strength of the body portion because the splines increase the wall thickness of the body portion by the depth of the splines. The complementarily engaging splines and grooves hold the first and second end members in place in the third bore and thus rotation applied to the first and second end members by chucks in the first and second bores is able to be transmitted to the body portion and to the roll of material on the core. Usually, the splines will extend the entire length of the third bore. The body portion can then easily be extruded.

In an alternative embodiment of the invention, the core is one in which the third bore is plain, and in which the insert portions of the first and second end members are plain. In this case, the insert portions of the first and second end members may be held in the third bore by an appropriate adhesive, or by other suitable and appropriate fixing means.

In all embodiments of the invention where the insert portions are employed, the first end member may have a first lead-in part, and the second end member may have a second lead-in part. The first and the second lead-in parts enable chucks easily to be inserted into the first and second bores of the first and second end members.

In all embodiments of the invention, the core may include screws which are used in the removable securing of the first and second members to the body portion.

The metal employed for the body portion is preferably aluminium. The aluminium is preferably an aluminium alloy. A presently preferred aluminium alloy is an aluminium magnesium silicon alloy. Such an aluminium magnesium silicon alloy is manufactured under the Trade No. 6063TA and it is used for aircraft structural parts. The use of the aluminium alloy may permit rotational speeds up to three times faster than would be achievable with a body portion made of a plastics material.

The plastics material used for the first and second end members is preferably a polypropylene co-polymer.

The core of the present invention may include an identity tag for enabling tracking of the core in use.

Usually, the identity tag will be provided on one of the first and second members. If desired however the identity tag may be provided on both of the first and second end members. If one of the first and second end members becomes damaged, for example by a chuck, then that damaged end member can easily be replaced, the identity tag retrieved, and the remainder of the core retained.

Preferably, the identity tag is a radio frequency operable identity tag. Other types of identity tag may be employed.

The present invention also extends to a roll of material when including the core of the invention. The material is preferably printing paper but it may alternatively be wallpaper, cardboard, plastics film, foil or fabric. The plastics film may be used in the wrapping industry or the packaging industry. The foil may be made of a plastics material or a metal, for example aluminium. The fabric may be for use as clothing, cloth or curtains.

Embodiments of the invention will now be described solely by way of example and with reference to the accompanying drawings in which:

FIGS. 1-3 shown schematically three user steps leading to failure of a known cardboard core;

Figure 1:
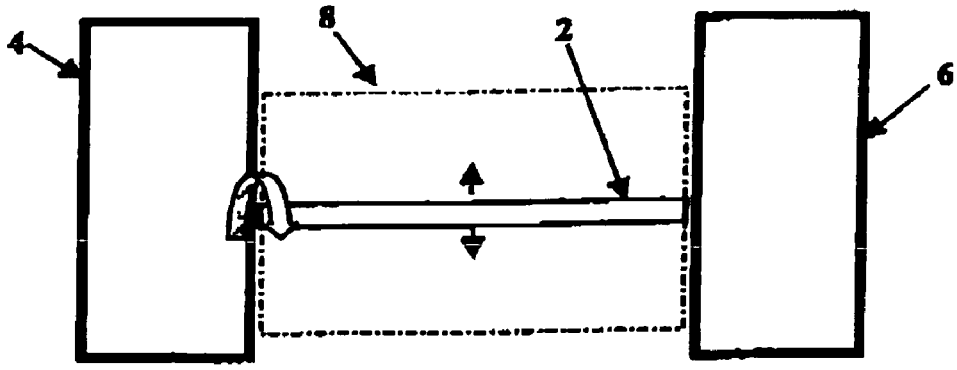
FIG 1 (Prior Art)

Referring to FIG. 1, there is shown a core 2 which is made of a cardboard material. The core 2 is shown positioned between two mounting blocks 4, 6 which are shown schematically and which may form appropriate parts of a wide variety of printing machines. The core 2 may be required to have a length of 700 mm to more than 4300 mm. When a roll of paper 8 has nearly run out on the core 2, the core may be spinning at 1400-2900 revolutions per minute.

Figure 2:
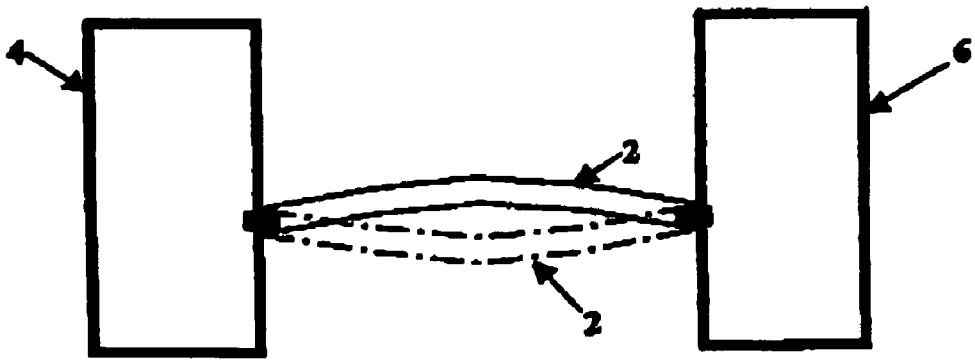
FIG 2 (Prior Art)

FIG. 2 shows how the core 2 has a tendency to start to spin out of control. The result of the core 2 becoming deformed to the shape as shown in FIG. 2 is that the core 2 is subject to high vibration and it is whirling out of a straight line.

Figure 3:
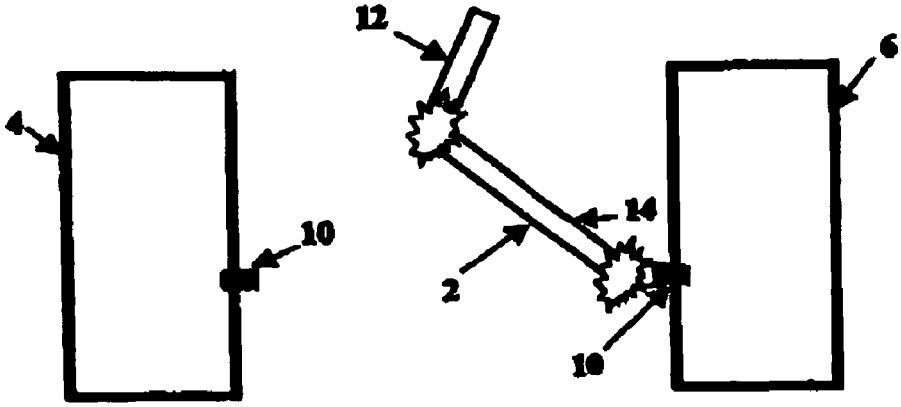
FIG 3 (Prior Art)
Figure 4:
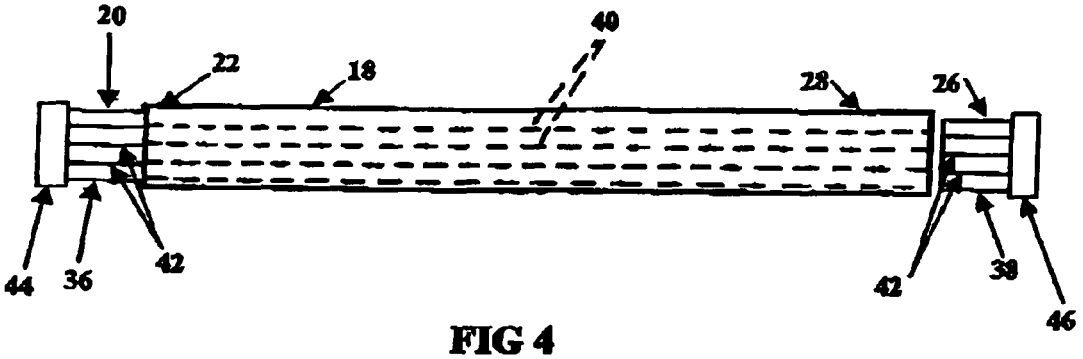
FIG. 4 is a partially exploded view of a first core of the present invention.

FIG. 3 shows what happens if spinning of the core 2 continues when the core 2 is in the condition shown in FIG. 2. More specifically, it will be seen from FIG. 3 that the core 2 has broken into large pieces which come adrift from mounting supports 10. Large broken pieces 12, 14 of the core 2 either fly out of the printing machine and may thus cause damage to personnel working in the vicinity of the printing machine, or they strike parts of the printing machine and thereby possibly damage the printing machine. This is all clearly dangerous and health and safety regulations require that it should not happen.

If the core 2 is alternatively made of a plastics material, then a substantial improvement is obtained over the use of cardboard for the core 2. Nevertheless, the demands of the printing industry constantly require larger and larger rolls of paper and greater and greater speeds of rotation of the cores. With rolls of paper having diameters greater than 1.5 meters, and for fast revolutionary speeds, a core 2 made of a plastics material will also tend to become deformed to the shape shown in FIG. 2. This is because the plastics material becomes hot during use, and the plastics material for the core 2 then becomes insufficiently strong to retain the roll of paper 8 during use. The result is at least the high vibration and whirling out of straight as occurs with the cardboard core 2 and as shown in FIG. 2. This may at best require machinery to be shut down, with consequent loss of production time and the possibility of expensive missed deadlines. In extreme cases, the core 2 made of the plastics material may break loose from the mounting supports 8, with the consequent danger to personnel and machinery.

Referring now to FIGS. 4-7 there is shown a first core 16 of the present invention. The core 16 is for a roll of printing material (not shown). The core 16 comprises a body portion 18, a first end member 20 which is removably secured to a first end 22 of the body portion 18, and a first bore 24 through the first end member 20. The core 16 also comprises a second end member 26 which is removably secured to a second end 28 of the body portion 18. A second bore 29 (see FIG. 8) extends through the second end member 26. The first and the second end members 20, 26 are of the same construction. A third bore 30 extends through the body portion 18.

The first bore 24, the second bore 29 and the third bore 28 all have a common longitudinal axis. The first bore 24 has a smooth inner surface 30 whereby the first bore 24 is able to receive a chuck 34 such that centering of the chuck 34 is facilitated by the smooth inner surface 32 of the first bore 24. Similarly, the second bore 29 has a smooth inner surface whereby the second bore 29 is able to receive a chuck (not shown) such that centering of this chuck is facilitated by the smooth inner surface of the second bore.

The body portion is made of a metal in the form of an aluminium magnesium silicon alloy which is known in the aircraft structural industry by No. 6063TA. The first and the second end members 22, 26 are made of a plastics material in the form of a polypropylene co-polymer. The polypropylene co-polymer is such that it is sufficiently soft to grip the chucks such that, in use, the chucks in the first and second end members 20, 26 do not turn relative to the first and second end members 20, 26. This is especially important if machinery is used which effects rotational braking through the chucks, thereby producing very high torque levels. The plastics material first and second inserts act as a flexible drive coupling, absorbing sudden or high levels of braking. At such high levels of braking, cardboard would de-laminate. The plastics material is also sufficiently soft that it does not crack during use, especially at cold temperatures. The use of the aluminium alloy for the body portion 18 enables the body portion 18 to be made longer and to support heavier loads during fast rotational speeds of the core 16 than would be the case if the body portion 18 were made of cardboard or a plastics material. If the body portion 18 were to be made of cardboard or a plastics material, then the fast rotational speeds would tend to cause the body portion 18 to bend or break as shown in FIGS. 2 and 3.

The first end member 20 is inserted into the third bore 30 at the first end 22 of the body portion 18. Similarly, the second end member 26 is inserted into the third bore 30 at the second end 28 of the body portion 18. More specifically, the first end 22 of the body portion 18 receives an insert portion 38 on the first end member 20. Similarly, the second end 28 of the body portion 18 receives an insert portion 38 on the second end member 26.

Figure 5:
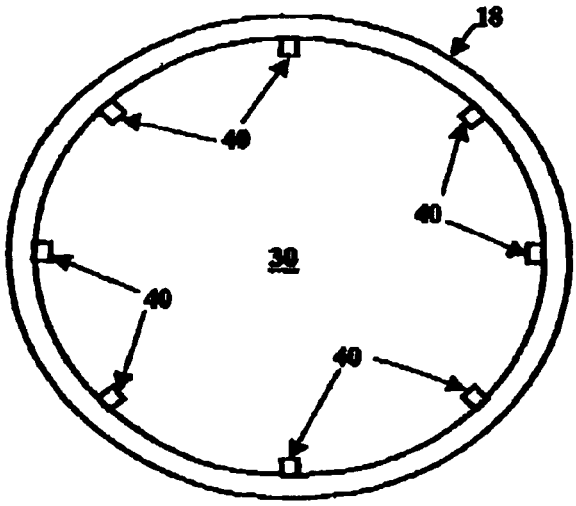
FIG. 5 is an end view of a body portion of the core shown in FIG. 4.

The body portion 18 is such that the third bore 30 has longitudinally extending splines 40. The insert portions 36, 38 on the first and second end members 20, 26 respectively have complementary grooves 42. The splines 40 and the grooves 42 lock together to enable rotation applied to the first and second end members 20, 26 to be applied to the body portion 18. Additionally, as can best be appreciated from FIG. 5, the splines 40 act as reinforcing members for the body portion 18. The splines 40 as shown in FIG. 5 are of the same thickness as the thickness of the body portion 18. Thus, at the positions of the splines 40, the body portion 18 is effectively twice its normal thickness. This helps the body portion 18 to support very heavy paper loads, for example up to three tons in a width of 2.2 meters, and at high revolutions, for example 2900 revolutions per minute at the point where the paper on the core 16 is close to running out, this point being known as the point of splice. The body portion 18 may be spun at 4200 revolutions per minute, and it may be used in lengths up to 4.5 meters. Thus although the aluminium is more expensive than plastics material, it is able to be used in more extreme conditions, and it may have three times the life that a comparable body portion 18 made of a plastics material would have. This increased life reduces the significance of the initial increased expense of the aluminium as compared with the initial expense of the plastics material. Additionally, there is the further point that the aluminium body portion is able to be used in longer lengths than plastics materials, at higher speeds of revolution, and with heavier paper loads. Still further, the use of the aluminium is environmentally friendly insofar as it avoids the disposal of a relatively large number of body portions 18 and their associated first and second end members 20, 26 made of a plastics material.

The first end member 22 has a first flange 44 which abuts against the first end 22 of the body portion 18. Similarly, the second end member 26 has a second flange 46 which abuts against the second end 28 of the body portion 18. The body portion 18 has an uninterrupted outer surface which is such that the first and second ends of the body portion are not reduced in material and strength. The first and second flanges 44, 46 and the body portion 18 all have the same outside diameter such that the core 16 has a continuous rigid outer surface for receiving the roll of printing material. Screws 47 may be used for removably securing the first and second end members 22, 26 to the body portion 18.

Figure 6:
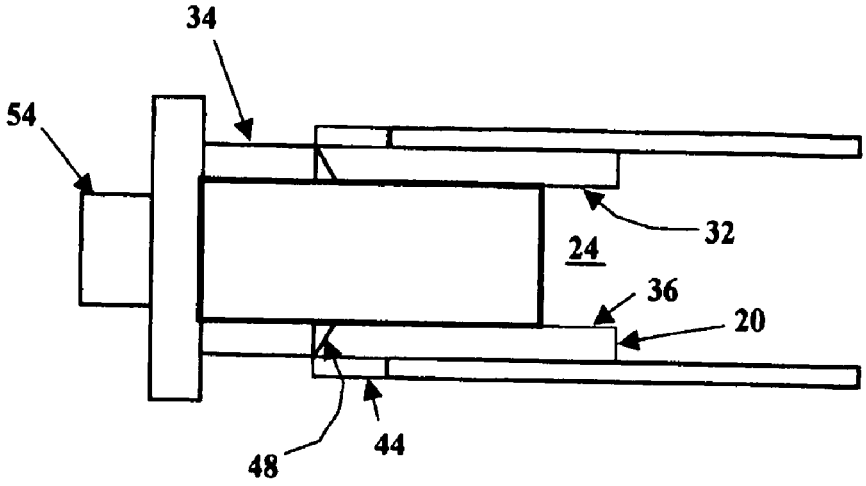
FIG. 6 is a section through one end of the core shown in FIG. 4 and shows the insertion of a chuck for enabling the core to be used as shown generally in FIG. 1.

As shown in FIG. 6, the first end member 20 has a first lead-in part 48. This first lead-in part 48 is for facilitating the insertion of the chuck 34 into the bore 24. Similarly, the second end member 26 has a second lead-in part 49 for facilitating insertion of a chuck 34 in its bore.

Figure 7:
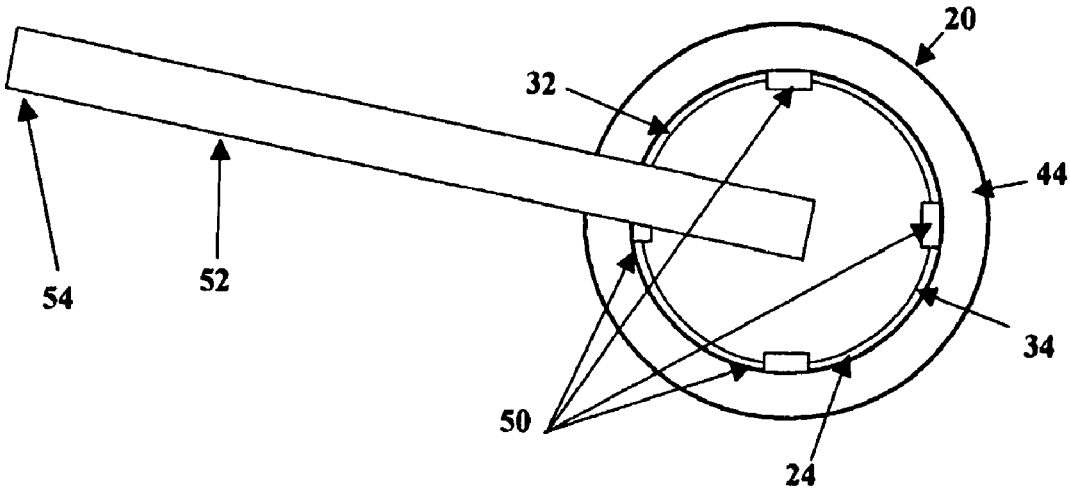
FIG. 7 is an end view illustrating how the core shown in FIG. 6 is tightened.

FIG. 7 shows the chuck 34 in the first bore 24 of the first end member 20. It will be seen that the chuck 34 has four gripping members 50 which grip the smooth inner surface 32 of the first bore 24. FIG. 7 also shows the use of a long bar 52, for example 1 meter long. Very high pressure is applied to the end of the bar 52 in the direction of the illustrated arrow 54. This causes clockwise rotation of the chuck 34 in the first bore 24 and it causes the gripping members 50 tightly to grip the smooth inner surface 32. By this means, the chuck 34 is easily able to be centred in the first bore 24, and is also able to be sufficiently tightly retained in the first bore 24 for a driving force to be applied to the chuck so that the entire core 16 can be turned.

Figure 8:
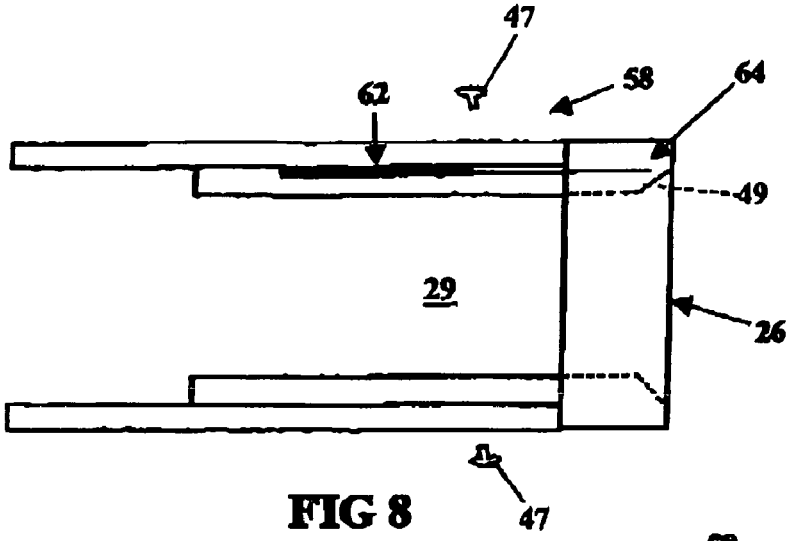
FIG. 8 shows the right hand end of a second core of the present invention, the second core having an identity tag.
Figure 9:
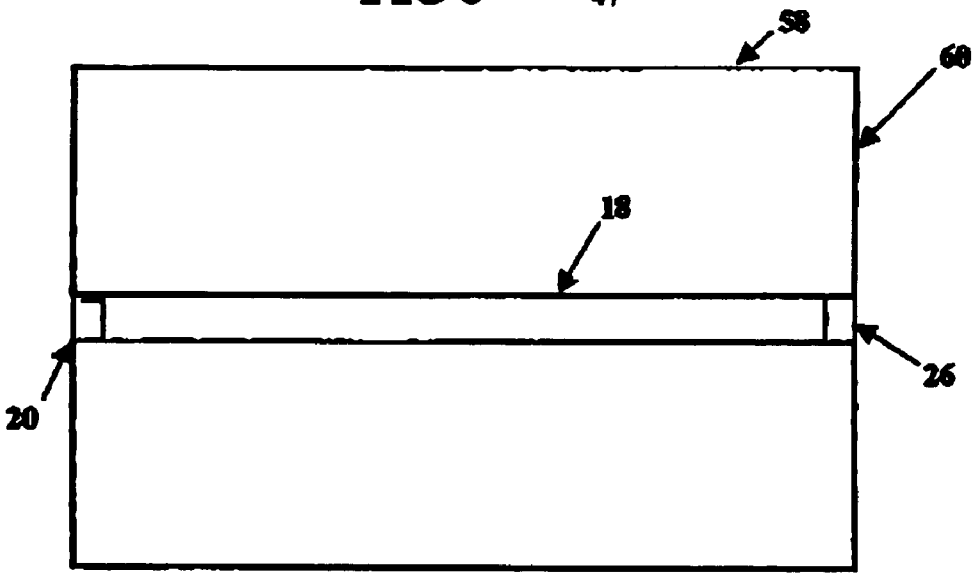
FIG. 9 shows the core of FIG. 8 in use.
Figure 10:
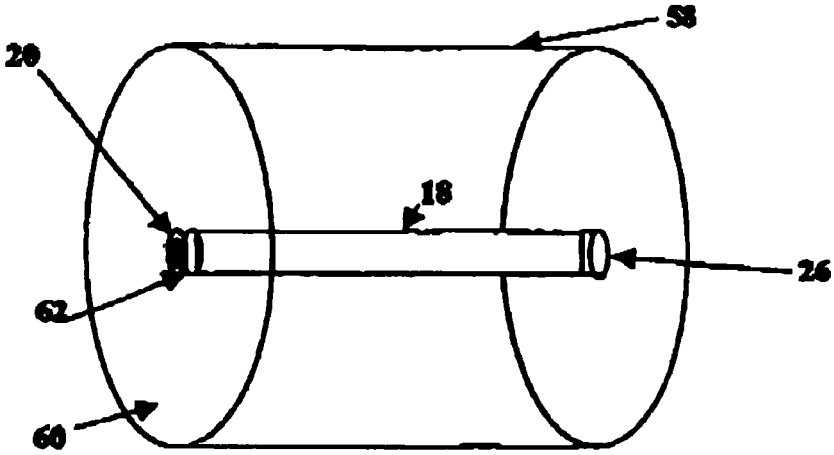
FIG. 10 is a schematic perspective view of the core in use as shown in FIG. 9.

Referring now to FIGS. 8, 9 and 10 there is shown a second core 58 of the present invention. Similar parts as in the core 2 have been given the same reference numerals for ease of comparison and understanding. Thus the second core 58 has a body portion 18, a first end member 20 and a second end member 26. The core 58 is shown supporting a roll of paper 60.

An identity tag 62, which is a radio-frequency identity tag 62, is secured as shown to the outside of the first and/or second end member 20, 26. The identity tag 62 has an antenna 64 which is exposed in the flanges 44, 46 in order to be able to transmit to a control station. The transmission will usually be the transmission of a unique identity number or other appropriate identity. The use of the identity tag or tags 62 enables the roll of paper 60 to be tracked as it passes from a paper mill to a warehouse, a dock, a customer paper store and a printing machine. The identity tags 62 are a significant cost item and they are able to be saved if the first and/or second end members 20, 26 become damaged. Instead of throwing away the entire core 58, the damaged first or second end member 20, 26 can be replaced, and the identity tag 62 retrieved and re-used. The identity tag 62 will usually only be fitted to one of the first and second end members 20, 26. However, with cores over one meter long, or where machinery, logistics or control parameters require it, an identity tag 62 may be fitted to both of the first and second end members 20, 26. If desired, the identity tag can be secured to the body portion 18, for example in the middle of the body portion 18. In this case, two wire antennae may be employed, with one each extending to either end of the body portion 18 and into the end member 20, 26 at that end of the body portion 18. The body portion 18 acts like a Faraday cage and would normally prevent or interfere with signal transmissions. However, because the identity tag 62 has an antenna terminating in one or both of the first and second end members 20, 26, the antenna extends beyond the end of the body portion 18 and signal transmission is able to be achieved.

It is to be appreciated that the embodiments of the invention described above with reference to the accompanying drawings have been given by way of example and that modifications may be effected. Thus, for example, the cores 16, 58 can be used for material other than paper.

The invention claimed is:

1. A core for a roll of material, which core comprises a body portion, a first end member which is removably secured to a first end of the body portion, a first bore through the first end member, a second end member which is removably secured to a second end of the body portion, a second bore through the second end member, and a third bore through the body portion, the first, second and third bores all having a common longitudinal axis, the first bore having a smooth inner surface whereby the first bore is able to receive a chuck such that centering of the chuck is facilitated by the smooth inner surface of the first bore, the second bore having a smooth inner surface whereby the second bore is able to receive a chuck such that centering of the chuck is facilitated by the smooth inner surface of the second bore, the body portion being made of a metal, the first and second end members each being made of a plastics material, the first end member having a first flange which abuts against the first end of the body portion, the second end member having a second flange which abuts against the second end of the body portion, the body portion having an uninterrupted outer surface which is such that the first and second ends of the body portion are not reduced in material and strength, the first and second flanges and the body portion all having the same outside diameter such that the core has a continuous rigid non-deformable outer surface for receiving the roll of material, and the core including radio frequency operable identity tag for enabling tracking of the core in use.

2. A core according to claim 1 in which the first end member is inserted into the third bore at the first end of the body portion, and in which the second end member is inserted into the third bore at the second end of the body portion.

3. A core according to claim 2 in which the first end of the body portion receives an insert portion on the first end member, and in which the second end of the body portion receives an insert portion on the second end member.

4. A core according to claim 3 in which the third bore has longitudinally extending splines, and in which the insert portions on the first and second end members have complementary grooves.

5. A core according to claim 4 in which the splines extend the entire length of the third bore.

6. A core according to claim 1 in which the third bore is smooth, and in which the insert portions of the first and second end members are smooth.

7. A core according to claim 1 in which the first end member has a first lead-in part, and in which the second end member has a second lead-in part.

8. A core according to claim 1 and including screws which are used in the removable securing of the first and second end members to the body portion.

9. A core according to claim 1 in which the metal is aluminium.

10. A core according to claim 9 in which the aluminium is an aluminium alloy.

11. A core according to claim 10 in which the aluminium alloy is an aluminium magnesium silicon alloy.

12. A core according to claim 1 in which the plastics material is a polypropylene co-polymer.

13. A core according to claim 1 in which the identity tag is on at least one of the first and second end members.

* * * * *